US005378961A

United States Patent [19]

Shiro et al.

[11] Patent Number: 5,378,961

[45] Date of Patent: Jan. 3, 1995

[54] DEFLECTION YOKE APPARATUS

[75] Inventors: Yusaku Shiro, Fukaya; Takeshi Kitahara, Kumagaya, both of Japan

[73] Assignee: Kabushiki Kaisha Toshiba, Kawasaki, Japan

[21] Appl. No.: 236,166

[22] Filed: May 2, 1994

Related U.S. Application Data

[63] Continuation of Ser. No. 899,862, Jun. 17, 1992, abandoned.

[30] Foreign Application Priority Data

Jun. 19, 1991 [JP] Japan ..... 3-147564

[51] Int. Cl.[6] ..... H01J 29/70

[52] U.S. Cl. ..... 313/440; 313/430; 335/210

[58] Field of Search ..... 313/440, 412, 421, 428, 313/433, 437, 430; 335/210, 212

[56] References Cited

U.S. PATENT DOCUMENTS

| | | | |
|---|---|---|---|
| 4,636,684 | 1/1987 | Yokota et al. | 313/412 |
| 4,939,415 | 7/1990 | Iwasaki et al. . | |
| 5,099,169 | 3/1992 | Vriens | 313/402 |

FOREIGN PATENT DOCUMENTS

| | | | |
|---|---|---|---|
| 54-2623 | 1/1979 | Japan | 313/440 |
| 56-6357 | 1/1981 | Japan | 313/440 |
| 56-162455 | 12/1981 | Japan . | |
| 63-80756 | 5/1988 | Japan . | |
| 285851 | 11/1988 | Japan | 313/440 |
| 129018 | 6/1989 | Japan . | |
| 183947 | 7/1990 | Japan | 313/440 |
| 2083689 | 4/1982 | United Kingdom . | |

*Primary Examiner*—Donald J. Yusko
*Assistant Examiner*—Vip Patel
*Attorney, Agent, or Firm*—Cushman Darby & Cushman

[57] ABSTRACT

A pair of saddle type horizontal deflection coils are provided at those upper and lower places on the inner wall of the coil separator. Vertical deflection coils toroidally wound on a core are provided on the outer periphery of the coil separator. Neck-side magnetic pieces are provided at those upper and lower sides of the neck-side area between the coil separator on one hand and the vertical deflection coils on the other hand. A pair of magnetic pieces, right and left, are provided, as a pair of crossarms, on the coil separator at a front-side section. In a deflection yoke apparatus thus provided, magnetic field creation areas at the crossarms are provided mainly on a Y axis side and four permanent magnets are provided on the front-side flange section of the coil separator at an angle of about 10° relative to an X axis so that these permanent magnets are magnetized substantially in a tube direction of a CRT.

5 Claims, 5 Drawing Sheets

DEFLECTION YOKE APPARATUS

This is a continuation of application Ser. No. 07/899,862, filed on Jun. 17, 1992, which was abandoned upon the hearing hereof.

BACKGROUND OF THE INVENTION

1. Field of the Invention

The present invention relates to a deflection yoke apparatus for use in a color CRT and display device.

2. Description of the Related Art

A recent tendency of a CRT (hereinafter referred to merely as CRT) for color reception has been toward broadening a deflection angle and flattening a screen panel and, at the same time, improving the quality of an image. A deflection yoke system for CRT is normally of a convergence-free type. A pincushion-free system has also been increasingly utilized which eliminates the need to provide an extra deflection deformation correction circuit.

In a deflection yoke apparatus for convergence-free and pincushion-free systems, horizontal deflection coils create pincushion type magnetic field distributions so as to achieve a convergence-free state, and vertical deflection coils are so arranged as to provide barrel-type magnetic field distribution. A pair of magnetic pieces CROSS ARMS, right and left, are provided on the front-side section of deflection yoke DY in order to mainly correct for right and left pincushion distortion areas.

The broader the angle at which an electron beam is deflected and the flatter the panel screen, the greater the upper and lower, right and left pincushion distortion areas. It is, therefore, normally necessary that, in order to correct for the pincushion distortion, a more intense pincushion distortion pattern must be obtained as a front-side magnetic field distribution on the deflection yoke apparatus.

If, in order to gain a pincushion type magnetic field distribution, a measure is taken with the winding distributions, etc., of the horizontal and vertical deflection coils per se, then a vertical misconvergence (M-PQV) is increased in a middle of those right and left end sides of the screen. The vertical misconvergence (M-PQV) can be decreased to some extent by adjusting the winding distribution of the horizontal deflection coils, but there is a limit on the achievement of such a decrease of the vertical misconvergence involved. Therefore, a countermeasure is taken through a balance between M-PQV and PQV, where PQV is a vertical misconvergence at the corners of the Ranel screen. For example, if the vertical misconvergence (M-PQV) is decreased through the adjustment of the winding distributions in the horizontal deflection coils, then the vertical misconvergence at the corners of the image screen PQV is increased.

In the deflection yoke apparatus for the display device, etc., an attempt has been made to provide a correction circuit as, for example, in Published Examined Japanese Patent Application H-1-29018 so that correction may be made for misconvergences M-PQV and PQV. In this case, the resultant apparatus becomes expensive due to the addition of the correction circuit.

According to the conventional apparatus, as set out above, the misconvergences PQV and M-PQV become larger and, in additional case of an extra correction circuit, a higher cost is involved.

SUMMARY OF THE INVENTION

It is accordingly the object of the present invention to provide a pincushion-free type deflection yoke apparatus which achieves a proper convergence which is free from PQV and M-PQV misconvergences.

In order to achieve the aforementioned object of the present invention, there is provided a deflection yoke apparatus comprising:

a coil separator having a hollow area so shaped as to substantially conform to an outer periphery of a cathode ray tube at a merged neck/funnel area;

a pair of saddle type horizontal deflection coils located on an inner surface of the coil separator on upper and lower sides;

vertical deflection coils located on the outer periphery of the coil separator and toroidally wound on a bobbin-like core;

a pair of upper and lower magnetic pieces provided on the neck-side of the coil separator at an area between the vertical deflection coil and the coil separator, first and second crossarms provided, as a pair of right and left crossarms, on a front-side flange section of the coil separator, the first and second crossarms extending in an up/down direction along the outer periphery of the coil separator in a manner to have their ends placed near each other in a Y axis direction to provide magnetic field creation area at their ends; and four permanent magnets arranged on the front-side flange section of the coil separator and located, in a spaced-apart relation, at an angle of about 10° relative to an X axis extending in the right/left direction with a tube axis as a center, whereby their magnetizations are oriented in substantially the tube axis direction.

According to this specific arrangement, correction is made for the upper and lower pincushion distortion areas using the magnetic field creation areas of the crossarms provided nearer the Y axis. However, the right/left pincushion distortion areas grow larger. In order to correct for the right/left pincushion distortion areas, a convergence is taken while the magnetic field distribution originating from the vertical deflection yoke is created more toward pincushion magnetic field distribution side. By so doing, the vertical deflection magnetic field distribution is totally made a barrel type magnetic field distribution through the utilization of the pair of neck-side magnetic pieces, upper and lower. Further the four permanent magnets, being located in those positions as set out above, can correct for the misconvergence M-PQV.

DETAILED DESCRIPTION OF THE PREFERRED EMBODIMENTS

An embodimentof the present invention will be explained below with reference to the accompanying drawings.

A basic deflection yoke apparatus to which the present invention applies will be explained below with reference to FIG. 1.

Figure 1A:
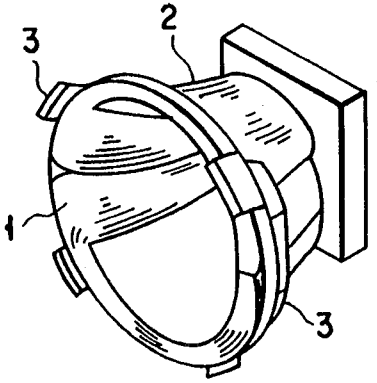
PRIOR ART FIG. 1A
FIG. 1A is a perspective view showing an outer appearance of a deflection yoke apparatus.

A deflection yoke apparatus as shown in FIG. 1A comprises a convergence-free system and pin cushion-free system. In the deflection yoke system, a horizontal deflection coil 1 for convergence-free implementation creates a pincushion type magnetic field distribution and a vertical deflection coil 2 creates a barrel type magnetic field distribution. A pair of magnetic pieces (hereinafter referred to crossarms) 3, right and left, are provided on a front side in order to mainly correct for a pincushion distortion at the right and left sections of a CRT.

Figure 1B:
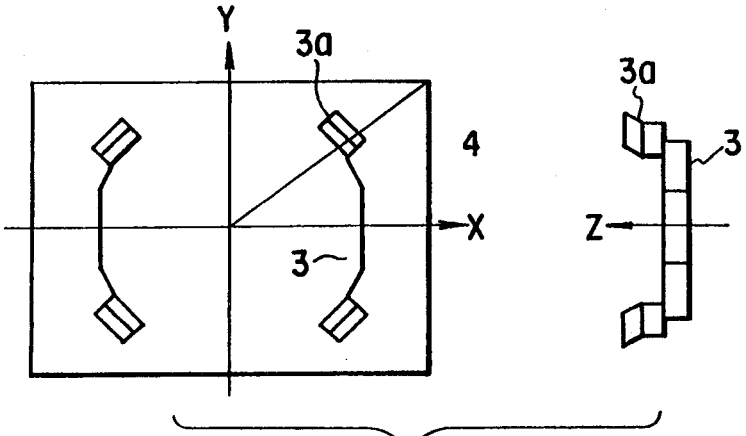
PRIOR ART FIG. 1B
FIG. 1B is an explanative view showing crossarms provided on the deflection yoke apparatus of FIG. 1A.
Figure 1C:
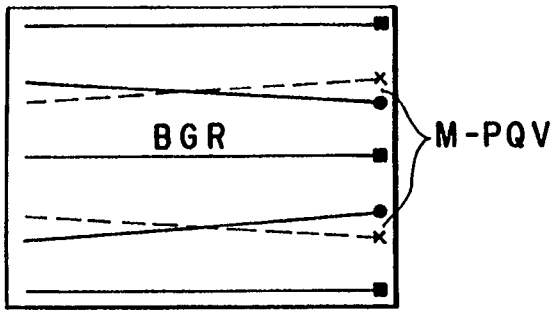
PRIOR ART FIG. 1C
FIGS. 1C and 1D are explanative views showing a misconvergence.
Figure 1D:
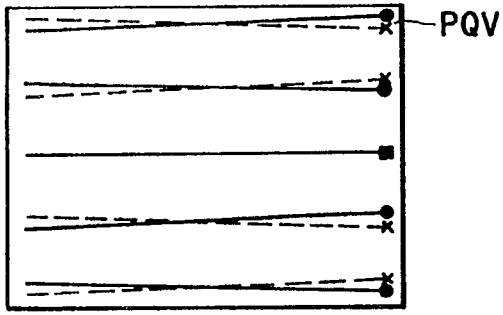
PRIOR ART FIG. 1D

FIG. 1B is a plan view on the X and Y axes showing the shape of the crossarms 3 and a side view on the Y and Z axes. The X axis and Y axis correspond to the horizontal and vertical directions, respectively, of the viewing screen of CRT and the Z axis corresponds to the tube direction of CRT. Field formation areas 3*a* of the crossarms 3 are mounted on the front side of a coil separator and substantially located at the upper and lower and right and left areas of the viewing screen (a panel screen) of CRT so as to correct for the right and left pincushion distortions. The broadening of the deflection angle of an electron beam, as well as the flattening of the panel screen, increases the upper and lower pincushion distortion areas and right and left pincushion distortion areas. In order to correct for the pincushion distortion, it is required that the magnetic field distribution on the front side of the deflection yoke apparatus be made more than the pincushion configuration. If the magnetic distribution of the pincushion type is enhanced by the winding distributions, etc., in the horizontal and vertical deflection coils, then a vertical misconvergence (M-PQV) is increased at a middle area at those right and left ends of the viewing screen as shown in FIG. 1C, noting that in FIG. 1C the solid lines and broken lines represent the paths of R (Red) and B (Blue) beams, respectively. The vertical misconvergence (M-PQV) can be reduced to some extent by adjusting the winding distribution of the horizontal deflection coil. However, there is a limit on this adjustment. To this end, a measure is taken to obtain a balance between M-PQV and a vertical misconvergence (PQV) at the corner areas of the viewing screen as shown in FIG. 1D. That is, if the vertical misconvergence (M-PQV) is decreased through the adjustment of the winding distribution in the horizontal deflection coil, then the vertical misconvergence (PQV) is increased at the corner area of the viewing screen. Thus, an allowable balance is taken between those misconvergences (PQV) and (M-PQV).

An increased tendency toward the flattening of the image screen and broadening of the deflection angle causes a restriction if an adjustment is made for the aforementioned winding distribution only.

According to the present invention, it is possible to achieve a much smaller convergence through a proper compromise between PQV and M-PQV.

Figure 2B:
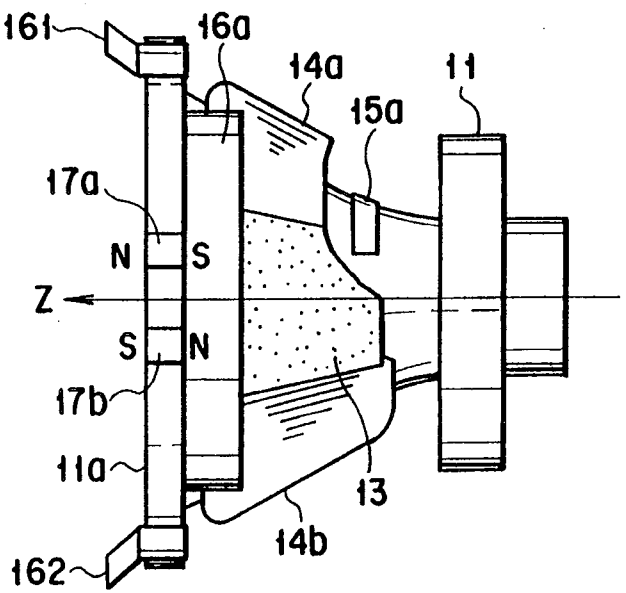
FIG. 2B is a side view showing the deflection yoke apparatus of FIG. 2A.
Figure 2A:
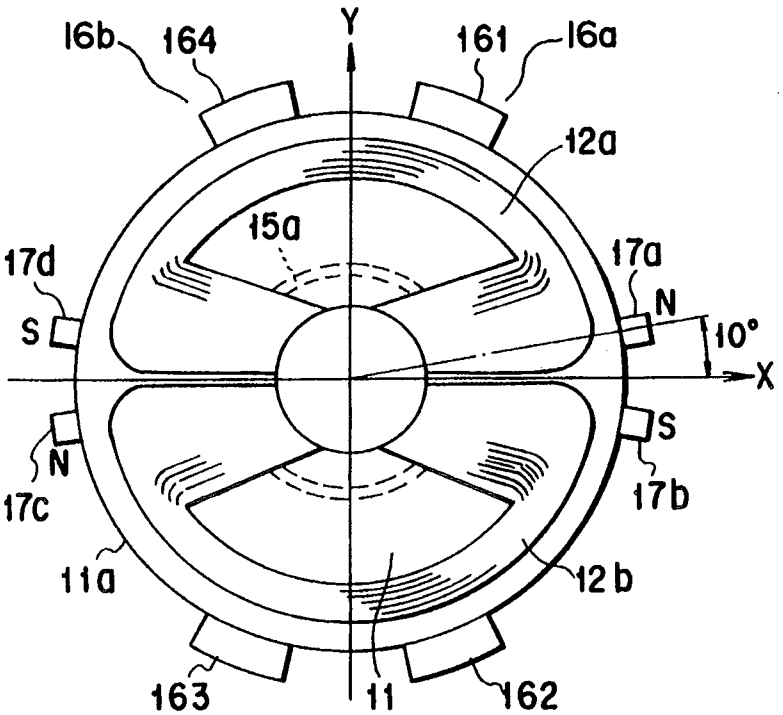
FIG. 2A is a front view showing a deflection yoke apparatus according to one embodiment of the present invention.

FIG. 2 shows one embodiment of the present invention. FIG. 2A is a front view on X and Y axes and FIG. 2B is a side view on the Y and Z axes. A coil separator 11 is comprised of an insulating bobbin whose hollow area is so shaped as to substantially conform to an outer periphery of CRT in the neighborhood of a boundary between the neck side and the fannel side of CRT. A pair of saddle type horizontal deflection coils 12*a*, 12*b* are incorporated into the inside of the coil separator 11 in an opposed relation with one of the coils at an upper side and the other coil at the lower side. A set of vertical deflection coils 14*a*, 14*b* is arranged outside the coil separator 11 such that they are toroidally wound around a core 13. In an area near the neck side of CRT which is situated between the coil separator 11 and the vertical deflection coil 14, a pair of neck-side magnetic pieces 15*a*, 15*b* (15*b*, not shown) are provided in the Y axis (up/down) direction on the coil separator 11.

Four permanent magnets 17*a*, 17*b*, 17*c* and 17*d* are arranged at a flange section 11*a* on the front side of the coil separator 11 such that they are located in those positions about 10° spaced apart from the X axis in which case these permanent magnets are magnetized in a substantially tube axis (Z axis) direction. The N and S poles as shown in FIG. 2(A) are those poles on the front side of the permanent magnets. The permanent magnets 17*a*, 17*d* are on the upper side of the X axis with the magnet 17*a* on the N pole side (on the front side) and the magnet 17*d* on the S side (on the front side). The permanent magnets 17*b*, 17*c* are on the lower side relative to the X axis with the magnet 17*b* on the S pole side (on the front side) and the magnet 17*c* on the N side (on the front side).

Crossarms 16*a*, 16*b* are mounted on the coil separator 11 at the front side of the coil separator 11 such that they extend, in an up/down direction, on the right/left sides along the outer periphery of the coil separator 11. In this arrangement, the ends of the crossarms 16*a*, 16*b* are closer to each other in the Y axis direction. Magnetic field creation areas 161 and 162 are provided on the upper and lower end side of the crossarm 16*a* and extend in the forward direction. Magnetic field creation areas 164 and 163 are provided on the upper and lower ends and extend in the forward direction.

The operation of the deflection yoke apparatus thus arranged will be explained below, first, stepwise in connection with individual components and finally in an integrated fashion.

First an explanation will be made below about how to correct for the right/left pincushion distortion areas and upper and lower pincushion areas.

Figure 3A:
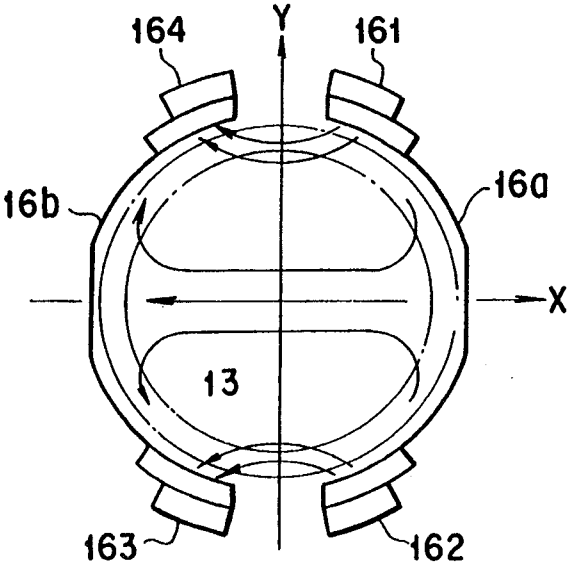
FIG. 3A shows an explanative view showing the magnetic fields ofcrossarms to explain the operation of a deflection yoke apparatus.
Figure 3B:
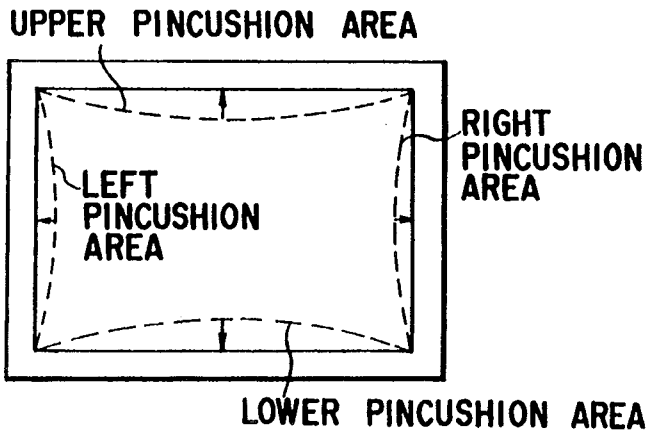
FIG. 3B is an explanative view showing a deflection distortion pattern originating from the deflection yoke apparatus.

The horizontal deflection magnetic field has a tendency for the neck side of the horizontal deflection coil 12 to be somewhat more distorted into a barrel type magnetic distribution than the front side so that, totally, it provides a pincushion magnetic field distribution. The vertical deflection coil 14 has such a predetermined winding angle as to create a somewhat pincushion type magnetic field distribution. The deflection distortion resulting from the action of the deflection coil only provides a pincushion distribution pattern as shown in FIG. 3B. If the crossarms (161 to 164) have their ends arranged particularly near the Y axis direction, as shown in FIG. 3A, so as to counter such a pincushion distribution pattern, then the upper and lower pincushion distortion areas are greatly corrected for as indicated by the solid lines in FIG. 3B. Also corrected for are right and left pincushion distortions. That is, those distortion areas as indicated by the broken lines in FIG. 3B are corrected to ones as indicated by the solid lines in FIG. 3B. FIG. 3A shows a vertical deflection magnetic field pattern when an electron beam is deflected and, as the magnetic field creation areas (161 to 164) are provided near the Y axis, an electron beam near the Y axis is greatly deflected. Correspondingly, the upper and lower pincushion distortion areas are more improved. In this connection, it is to be noted that an amount of correction of the right and left pincushion distortion areas is decreased by that extent. It is, therefore, necessary to determine the position and size of the magnetic field creation areas (161 to 164), while taking their balance into consideration.

Now, an explanation is made below about how the misconvergence should be corrected for.

Figure 3C:
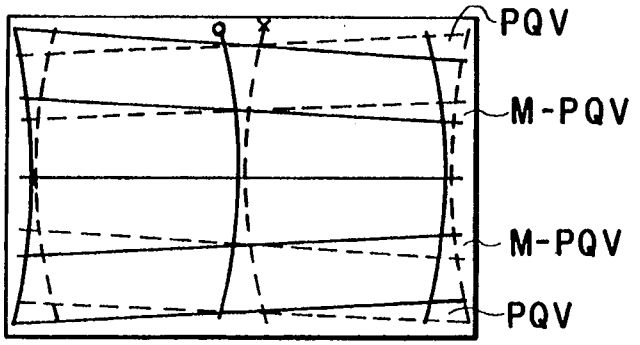
FIGS. 3C and 3D are explanative views for explaining a misconvergence caused by the deflection yoke apparatus.
Figure 3D:
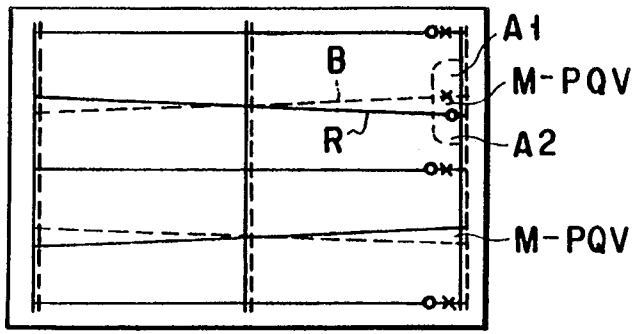

Though the deflection distortion is corrected for in a way set out above, a convergence at that time becomes such a pattern as shown in FIG. 3C, noting that those electron guns are arranged in B-G-R order toward the panel screen with a solid line with an open circle denoting a red (R) and a solid line with an x denoting a blue (B). With the neck-side magnetic pieces 15*a* and 15*b* arranged as set out above, a vertical deflection magnetic field is partially shielded at those areas, and a barrel type magnetic field is corrected for. Therefore, the total effect is that the vertical deflection magnetic field becomes a barrel type magnetic field distribution. It is, therefore, possible to obtain a convergence pattern as shown in FIG. 3D without imparting too much influence to the deflection distortion.

Here the misconvergence M-PQV only poses a problem.

The function of the permanent magnets (17*a*, 17*b*, 17*c*, 17*d*) at the front side will be explained below with reference to FIG. 4.

Figure 4A:
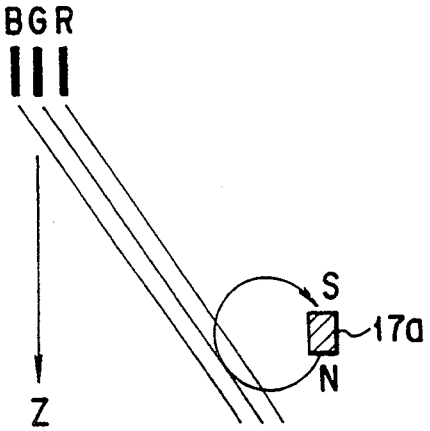
FIGS. 4A and 4B are explanative views for explaining the function of permanent magnets used in the present deflection yoke apparatus.
Figure 4B:
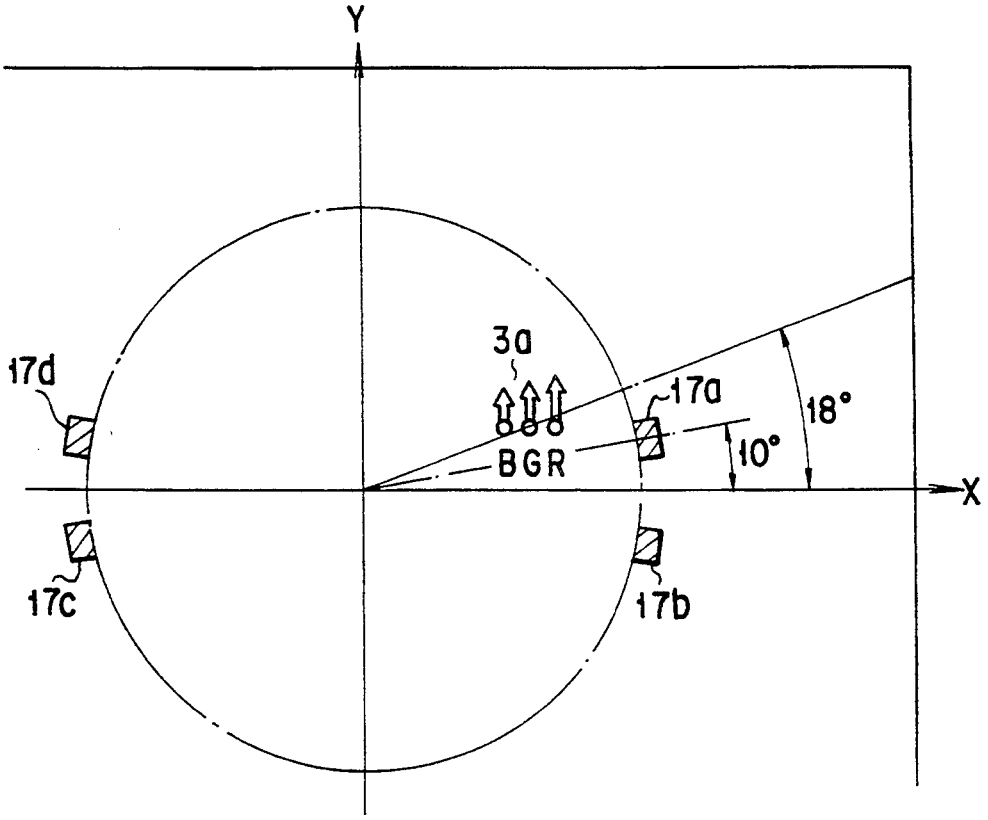

FIG. 4A shows a positional relation between the R, G and B beams as viewed in the X-Z axis plane and the permanent magnet 17*a*. FIG. 4B shows a similar relation of the permanent magnets 17*a* to 17*d* as viewed in the X-Y axis plane. From these Figures it will be seen that, of those forces of the permanent magnets 17*a* to 17*d* acting upon the electron beams, an upward force is greatest at the upper right area of the viewing screen, though acting in the X, Y and Z axis directions, due to the directions of the magnetic field and deflection current. FIG. 4B shows a state in which the magnetic field of the permanent magnet 17*a* acts upon the electron beam. In the right upper area of the image screen, the magnetic field of the permanent magnet 17*a* acts, as an upward field, upon the electron beam as shown in FIG. 3D. At that time, a red (R) beam is nearest the permanent magnet 17*a* and, in order to have that beam undergo the greatest upward force, the misconvergence M-PQV is corrected for at the right upper area in FIG. 3D. A similar principle works for the misconvergence M-PQV at the right lower area and left side. A corresponding explanation is, therefore, omitted.

In the arrangement of the permanent magnets (17*a* to 17*d*), a misconvergence M-PQV is present in the upper and lower places at an angle of about 18° to the X axis in the current television image screen whose aspect ratio is 4:3. When the electron beam reaching that place passes near either one of the permanent magnets 17*a* to 17*d*, then that angle is smaller than 18° to the X axis. In the experiments done with a 21 CPT/DY system (CPT: color picture tube and DY: deflection yoke), the best convergence characteristic has been obtained at about 10° to the X axis with the tube axis as a center. Although, in the aforementioned embodiment, the permanent magnets 17 have been explained as being provided on the outer peripheral surface of the flange section 11*a* of the coil separator 11, it may be provided on the inner wall surface of the flange section 11*a*. That is, no restriction is made as to whether the permanent magnets are provided inside or outside the flange section 11*a*. Further, the present invention can apply to the deflection yoke apparatus, etc., which, in order to correct for the upper and lower pincushion distortion areas, has a pair of permanent magnets, upper and lower, at the front-side flange section 11*a* of the coil separator 11.

It is because it is possible to obtain an advantage of reduced misconvergence that the permanent magnets 17*a* to 17*d* are placed at an angle of about 10° to the X axis. That is, this is because it can be so done even if that angle is made an angle of $\pm 5°$, say, in a range of 5° to 15°. For example, if the permanent magnets 17*a* are selectively set to their mount position P, that is $10° < p \leqq 15°$, then the misconvergence at the right upper area A1 can be effectively reduced on the image screen shown in FIG. 3D. Further, if the permanent magnet 17*a* is set to the mount position P, that is $5° \leqq p < 10°$, the misconvergence at the area A2 can be effectively reduced on the image screen (FIG. 3D).

In the present embodiment, the permanent magnets 17*a* to 17*d* are placed on the outer peripheral surface of the flange section 11*a*. However, these permanent magnets 17*a* to 17*d* may be mounted on the inner wall side of the flange section 11*a*.

Figure 5A:
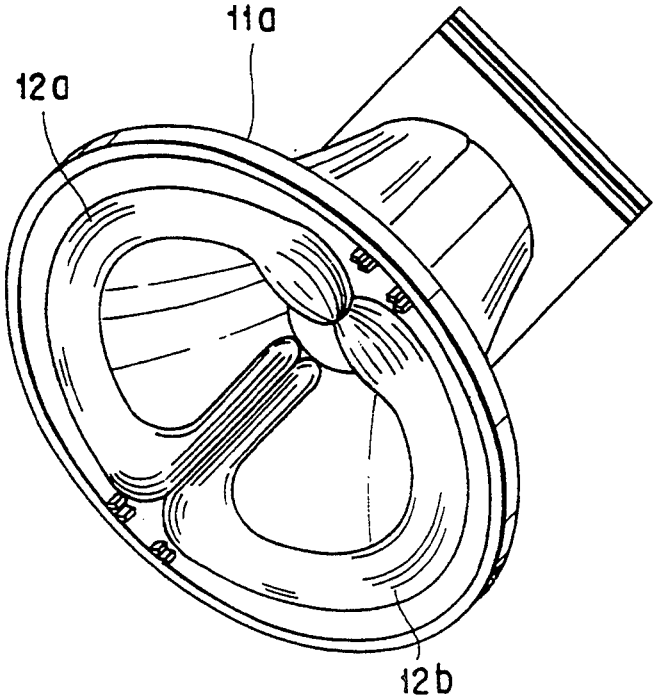
FIG. 5A is a view showing an outer appearance showing a deflection yoke apparatus according to another embodiment of the present invention.
Figure 5B:
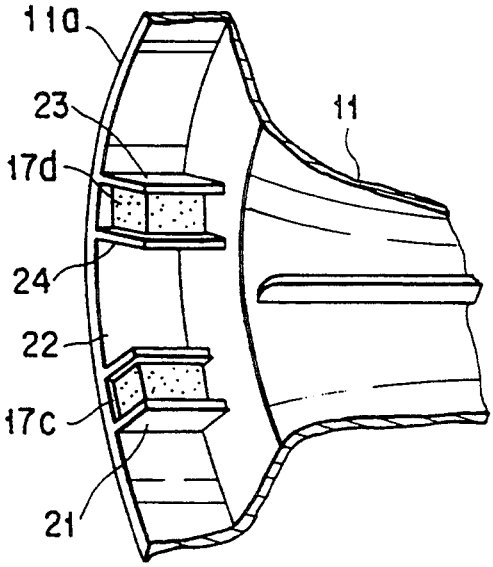
FIG. 5B is an explanative view showing a portion of the deflection yoke apparatus of FIG. 5A.

FIG. 5 shows an embodiment in which permanent magnets 17*a* to 17*d* are mounted on the inner wall side of the flange section 11*a*. In this embodiment, the same reference numerals are employed to designate parts or elements corresponding to those shown in the preceding embodiment. FIG. 5A shows a general arrangement of a deflection yoke apparatus and FIG. 5B is an enlarged view showing an area as indicated by the broken lines. The permanent magnets 17*c* and 17*d* are mounted on the inner wall of a flange section 11*a*. The permanent magnet 17*c* is held in a sandwiched relation by projections 21, 22 provided integral with the inner wall of the flange section 11*a*. Also the permanent magnet 17*d* is held in a sandwiched relation by projections 23 and 24 provided on the inner wall of the flange section 11*a*.

According to the present invention, as set out above, it is possible to provide a pincushion-free type deflection yoke apparatus which has a better compromise between those misconvergences PQV and M-PQV.

What is claimed is:

1. A deflection yoke apparatus comprising:

a coil separator having a hollow area so shaped as to substantially conform to an outer periphery of a cathode ray tube at a merged neck/funnel area, where the cathode ray tube has a viewing screen;

a pair of saddle type horizontal deflection coils located on an inner surface of the coil separator on upper and lower sides;

vertical deflection coils located on the outer periphery of the coil separator and toroidally wound on a bobbin-like core;

a pair of upper and lower magnetic pieces provided on the neck-side of the coil separator at an area between the vertical deflection coil and the coil separator;

first and second crossarms provided, as a pair of right and left crossarms, on a front-side flange section of the coil separator, the first and second crossarms extending in an up/down direction along the outer periphery of the coil separator in a manner to have their ends placed near each other in a Y axis direction to provide magnetic field creation area at their ends; and four permanent magnets arranged on the front-side flange section of the coil separator and located, in a spaced-apart relation, at an angle of about 10° relative to an X axis extending in the right/left direction with a tube axis as a center, whereby their magnetizations are oriented in substantially the tube axis direction thereby correcting vertically directed misconvergence occurring at a center region along right or left sides of the viewing screen.

2. The deflection yoke apparatus according to claim 1, wherein the permanent magnets are mounted on the outer periphery of the front-side flange section of the coil separator.

3. The deflection yoke apparatus according to claim 1, wherein the permanent magnets are mounted on the inner wall of the front-side flange.

4. The deflection yoke apparatus according to claim 1, wherein the cathode ray tube on which the deflection yoke apparatus is mounted has a viewing screen whose aspect ratio is 4:3.

5. The deflection yoke apparatus according to claim 1, wherein the cathode ray tube on which the deflection yoke apparatus is mounted has a viewing screen whose aspect ratio is 16:9.

* * * * *